US011408055B2

(12) United States Patent
Min et al.

(10) Patent No.: US 11,408,055 B2
(45) Date of Patent: Aug. 9, 2022

(54) COPPER ALLOY PRODUCTION METHOD AND METHOD FOR MANUFACTURING FOIL FROM COPPER ALLOY

(71) Applicant: SOLUETA CO., LTD., Ansan-si (KR)

(72) Inventors: Eui-Hong Min, Seongnam-si (KR); Sang-Ho Cho, Hwaseong-si (KR); Buck-Keun Choi, Hwaseong-si (KR)

(73) Assignee: SOLUETA CO., LTD., Ansan-si (KR)

( * ) Notice: Subject to any disclaimer, the term of this patent is extended or adjusted under 35 U.S.C. 154(b) by 118 days.

(21) Appl. No.: 16/498,793

(22) PCT Filed: Mar. 30, 2018

(86) PCT No.: PCT/KR2018/003797
§ 371 (c)(1),
(2) Date: Sep. 27, 2019

(87) PCT Pub. No.: WO2018/182368
PCT Pub. Date: Oct. 4, 2018

(65) Prior Publication Data

US 2020/0024690 A1 Jan. 23, 2020

(30) Foreign Application Priority Data

Mar. 31, 2017 (KR) ..... 10-2017-0041704

(51) Int. Cl.
*C22C 1/04* (2006.01)
*B22F 9/02* (2006.01)
(Continued)

(52) U.S. Cl.
CPC ..... *C22C 1/0425* (2013.01); *B22F 1/052* (2022.01); *B22F 1/054* (2022.01); *B22F 1/142* (2022.01);
(Continued)

(58) Field of Classification Search
CPC ..... B22F 1/052; B22F 1/054; B22F 1/0545; B22F 1/09; B22F 1/142; B22F 1/148;
(Continued)

(56) References Cited

U.S. PATENT DOCUMENTS

2002/0039542 A1 4/2002 Bogel et al.
2011/0056593 A1 3/2011 Lee et al.
2017/0028477 A1* 2/2017 Setna ..... B22F 1/025

FOREIGN PATENT DOCUMENTS

JP 2008-057046 A 3/2008
KR 10-2010-0111602 A 10/2010
(Continued)

OTHER PUBLICATIONS

Maria De Los A. Cangiano et al., "A study of the composition and microstructure of nanodispersed Cu-Ni alloys obtained by different routes from copper and nickel oxides," Materials Characterization, 2010, pp. 1135-1146, vol. 61, No. 11.
(Continued)

*Primary Examiner* — Anthony J Zimmer
*Assistant Examiner* — Dean Mazzola
(74) *Attorney, Agent, or Firm* — Sughrue Mion, PLLC

(57) ABSTRACT

The present invention relates to a copper alloy production method and a method for manufacturing foil from a copper alloy, and the copper alloy production method of the present invention includes: a metal oxide preparing process of preparing at least two metals, including copper, each of which is in the form of a metal oxide, a nano powder producing process of pulverizing the metal oxides to produce metal oxide nano powder having a nano size, and an alloy producing process of heat-treating the metal oxide nano powder to produce an alloy, whereby, when a copper alloy is produced, precipitates can be minimized, the characteristics of the alloy can be optimized, and the generation
(Continued)

of oxides on the outer wall of a molten metal furnace can be suppressed.

9 Claims, 4 Drawing Sheets

(51) Int. Cl.

| | |
|---|---|
| ***B22F 9/20*** | (2006.01) |
| ***C22C 9/00*** | (2006.01) |
| ***C22F 1/08*** | (2006.01) |
| ***B22F 1/142*** | (2022.01) |
| ***B22F 1/054*** | (2022.01) |
| ***C22C 9/06*** | (2006.01) |
| ***C22C 9/04*** | (2006.01) |
| ***B22F 9/04*** | (2006.01) |
| ***B22F 1/052*** | (2022.01) |

(52) U.S. Cl.
CPC ..... *B22F 9/026* (2013.01); *B22F 9/20* (2013.01); *C22C 9/00* (2013.01); *C22C 9/04* (2013.01); *C22C 9/06* (2013.01); *C22F 1/08* (2013.01); *B22F 2009/041* (2013.01); *B22F 2009/043* (2013.01); *B22F 2201/013* (2013.01); *B22F 2201/02* (2013.01); *B22F 2301/10* (2013.01); *B22F 2998/10* (2013.01)

(58) Field of Classification Search
CPC .. B22F 3/001; B22F 9/026; B22F 9/04; B22F 9/18; B22F 9/20; B22F 9/22; B22F 2009/041; B22F 2009/43; B22F 2201/013; B22F 2201/02; B22F 2301/10; B22F 2301/15; B22F 2301/30; B22F 2302/25; C22C 1/0425; C22C 5/08; C22C 18/02; C22C 19/002; C22C 21/12; C22C 30/02; C22C 45/001
See application file for complete search history.

(56) References Cited

FOREIGN PATENT DOCUMENTS

| | | | | | |
|---|---|---|---|---|---|
| KR | 20120068116 | A | * | 6/2012 | |
| KR | 10-2013-0109325 | A | | 10/2013 | |
| KR | 20130109325 | A | * | 10/2013 | |
| KR | 10-2016-0136805 | A | | 11/2016 | |
| WO | WO-2015162405 | A1 | * | 10/2015 | ..... B22F 1/0014 |

OTHER PUBLICATIONS

International Search Report of PCT/KR2018/003797 dated Jul. 23, 2018.

* cited by examiner

COPPER ALLOY PRODUCTION METHOD AND METHOD FOR MANUFACTURING FOIL FROM COPPER ALLOY

CROSS REFERENCE TO RELATED APPLICATIONS

This application is a National Stage of International Application No. PCT/KR2018/003797 filed Mar. 30, 2018, claiming priority based on Korean Patent Application No. 10-2017-0041704 filed Mar. 31, 2017, the entire disclosures of which are incorporated herein by reference.

TECHNICAL FIELD

The present invention relates to a copper alloy production method and a method for manufacturing foil from a copper alloy that is a raw material, and more particularly, to a copper alloy production method using nano powder having a nano size to minimize precipitates, optimize the characteristics of a copper alloy, and prevent the generation of oxides on the outer wall of a molten metal furnace when the copper alloy is produced and to a method for manufacturing foil from a copper alloy.

BACKGROUND ART

In general, copper foil is very thin and used to produce a thin wiring pattern on a printed wiring board.

A conventional method of manufacturing the copper foil includes a coating process for coating a synthetic resin film with an adhesive by using a coating roller, a drying process for drying the adhesive-coated synthetic resin film for a predetermined period of time, a laminating process for laminating the adhesive-coated synthetic resin film on copper foil, a winding process for aging the laminated copper foil for a predetermined period of time and winding the copper foil around a winding roller, and a cutting process for cutting the copper foil completely wound around the winding roller into an intended size.

However, the copper foil manufactured as described above is easily tom due to low tensile strength and elongation and cannot be easily applied to a curved part. Thus, for use as a conductive tape or the like, copper alloy foil produced by adding nickel, zinc, cobalt, etc. to copper is usually used.

Typically, since nickel (Ni) or zinc (Zn) is usually added to copper (Cu), the strength, oxidation resistance, and corrosion resistance increase. Cu as a basic element imparts toughness and facilitates cold work. Ni increases creep strength at high temperature and improves corrosion resistance. Further, Ni increases elastic modulus and electric resistance. As the content of Ni increases, a melting temperature range is shifted to high temperatures. Zn contributes to work hardening ability of the alloy and improves hot workability, but lowers corrosion resistance. As the content of Zn increases, the melting temperature range is shifted to low temperatures.

According to a conventional technology for producing a copper alloy by adding nickel, zinc, etc. to copper, a chunk of alloy materials such as copper, nickel, and zinc is put in a molten metal furnace and heated and boiled to a predetermined temperature to prepare a liquid form and then produce an alloy.

Typically, when copper, nickel, and zinc are boiled at a temperature of about 1400° C., the metals are transformed into liquid and then produced into an alloy. Conventionally, a chunk of copper, nickel, and zinc is put in a molten metal furnace, and, thus, a large amount of heat is needed to liquefy the metals and produce an alloy.

If an alloy can be produced from a powder form instead of a chunk form, the energy band gap for alloying is lowered, and, thus, the temperature for liquefaction can be greatly lowered. Actually, when metals in a powder form are alloyed, they can be alloyed at temperatures equivalent to 80% of the temperature for alloying a chunk of metals.

Therefore, a technology for producing an alloy with powdered metal powders is being researched. However, a conventional method is a plasma method using high energy in which plasma is used to release atoms and produce a complex salt. Thus, this method is very costly and uneconomical. Therefore, it is difficult to apply this method to the production of copper alloys.

Further, when metals such as copper, and nickel are pulverized into a powder form, the pulverized powder clumps together. This is because copper and nickel are metals and the pulverized powder can be easily bound to each other by metallic bond.

Therefore, a conventional technology for pulverizing a metal itself cannot make it possible to produce nanoscale metal powder.

Meanwhile, when a chunk of copper, nickel, etc. is put in a molten metal furnace and boiled therein to produce a copper alloy according to the conventional method, a large amount of oxides is generated on the outer wall of the molten metal furnace and thus needs to be removed.

Therefore, to solve the above-described problems, the present applicant repeatedly studied a method for pulverizing metals into nanoscale powder and alloying them and achieved the method, which is presented herein.

DISCLOSURE

Technical Problem

The present invention is conceived to solve the above-described problems and directed to providing a high-efficiency copper alloy production method in which metals such as copper, or nickel, are pulverized into a nano powder form and then produced into an alloy, and, thus, temperatures of heating and alloying the metal materials can be lowered to about 80%. Therefore, the method suppresses waste of energy and is economical and can be easily applied at industrial sites.

Further, the present invention is directed to providing a copper alloy production method capable of minimizing oxides generated on the outer wall of a molten metal furnace and optimizing the characteristics of an alloy when producing the alloy and a method for manufacturing foil from a copper alloy.

Technical Solution

One aspect of the present invention provides a copper alloy production method, including a metal oxide preparing process of preparing at least two metals, including copper, each of which is in the form of a metal oxide, a nano powder producing process of pulverizing the metal oxides to produce metal oxide nano powder having a nano size, and an alloy producing process of heat-treating the metal oxide nano powder to produce an alloy.

In the present invention, the metal oxides may include at least two of CuO, NiO, and ZnO.

In the nano powder producing process, the metal oxides may be physically pulverized with a rotary mill using a pulverizing medium to produce metal oxide nano powder having a nano size.

Herein, the pulverizing medium may use beads having a diameter of 0.3 mm to 3.0 mm, and in the nano powder producing process, the metal oxides may be pulverized at 1,000 rpm to 4,000 rpm for 5 hours to 20 hours using methanol or ethanol as a solvent to produce metal oxide nano powder.

The beads may be formed of at least any one material selected from SUS, Zr, carbon steel, and steel.

Further, the alloy producing process may include a nano powder aggregate producing process of applying hot air to the metal oxide nano powder to produce a nano powder aggregate and a heat-treating process of putting the nano powder aggregate in a molten metal furnace and performing heat treatment to produce an alloy.

In this case, in the nano powder aggregate producing process, the nano powder may be aggregated by using any one of a chamber spray dryer, a hot air dryer, and a disk wheel dry plate.

Further, in the nano powder aggregate producing process, the metal oxide nano powder is added at a specific rate for each kind, and process conditions may include a slurry feeding rate of 0.5 l/min to 3.5 l/min, an internal tank temperature of 30° C. to 35° C., and a spraying pressure of 0.2 kPa to 2.5 kPa.

Meanwhile, the alloy producing process may include a natural metal producing process of producing the metal oxide nano powder into natural metal nano powder by a reduction process in a hydrogen or nitrogen atmosphere and a heat-treating process of putting the natural metal nano powder in a molten metal furnace and performing heat treatment to produce an alloy.

Herein, in the natural metal producing process, process conditions may include a hydrogen or nitrogen flow rate of 2.5 l/min to 7.0 l/min, a temperature of 1,100° C. to 1,500° C., a process time of 0.5 hr to 5.0 hr.

Further, the copper alloy production method may further include a nano powder anti-oxidizing coating process of forming an anti-oxidizing film on the natural metal nano powder with an additive after the natural metal producing process.

Herein, the additive may include any one selected from triethanolamine (TEA), oleic acid, amine, and acid-based polymer and may be added in the amount of 0.05 wt % to 3.0 wt % (powder rate).

Meanwhile, another aspect of the present invention provides a method for manufacturing foil from a copper alloy, including a metal oxide preparing process of preparing at least two metals, including copper, each of which is in the form of a metal oxide, a nano powder producing process of pulverizing the metal oxides to produce metal oxide nano powder having a nano size, an alloy producing process of heat-treating the metal oxide nano powder to produce an alloy, a melting casting process of melting and casting the alloy, a treatment process of performing extrusion, hot rolling, and cold rolling after the casting process, and a heat-treating process of performing softening for imparting processability to a material through re-crystallization and annealing for removing residual stress caused by non-uniform plastic working.

Advantageous Effects

According to the present invention described above, metals such as copper, and nickel are prepared in the form of metal oxides and pulverized into nano powder, and, thus, it is possible to produce nanoscale metal powder and also possible to produce a copper alloy using the same.

As described above, metal materials are pulverized into a nano powder form and then produced into an alloy. Therefore, it is possible to greatly lower temperatures of heating the metal materials and thus possible to suppress waste of energy. Also, it is possible to produce a copper alloy using nano powder without requiring high cost.

Further, an alloy is produced from nano powder form in a molten metal furnace. Therefore, it is possible to minimize the generation of oxides on the outer wall of the molten metal furnace and thus possible to reduce waste of materials and eliminate unnecessary removal of the oxides. Also, it is possible to optimize the characteristics of the alloy.

DESCRIPTION OF DRAWINGS

FIG. 7 shows scanning electron microscope (SEM) images of the fracture surface of copper foil produced according to a conventional production method.

FIG. 8 shows scanning electron microscope (SEM) images of the fracture surface of copper alloy foil produced according to a copper alloy production method of the present invention.

BEST MODE OF THE INVENTION

Figure 1:
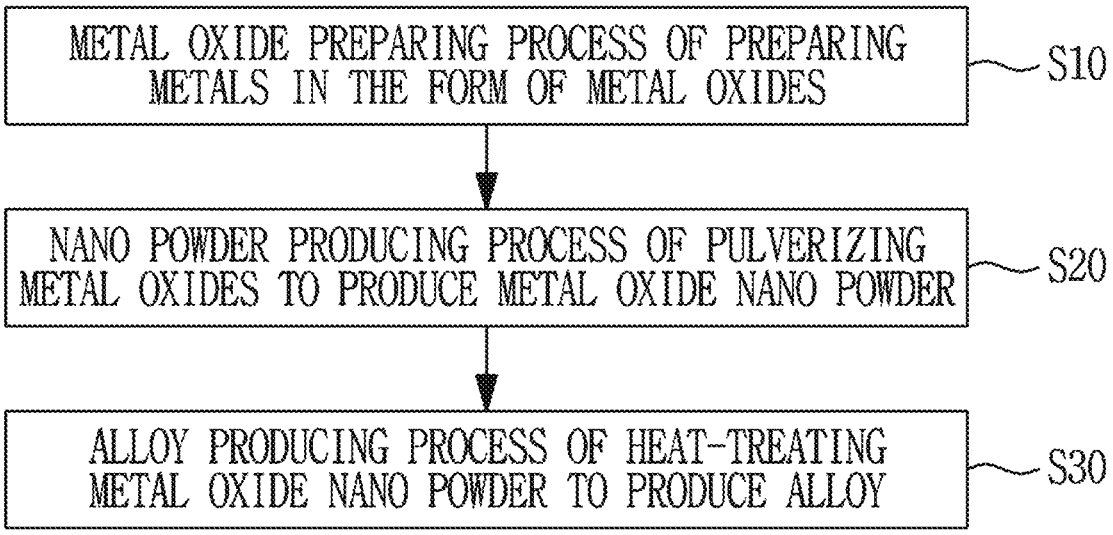
FIG. 1 is a flowchart showing a copper alloy production method according to the present invention.

To achieve the above-described purpose, the present invention provides a copper alloy production method, including a metal oxide preparing process of preparing at least two metals, including copper, each of which is in the form of a metal oxide, a nano powder producing process of pulverizing the metal oxides to produce metal oxide nano powder having a nano size, and an alloy producing process of heat-treating the metal oxide nano powder to produce an alloy.

In the present invention, the metal oxides may include at least two of CuO, NiO, and ZnO.

In the nano powder producing process, the metal oxides may be physically pulverized with a rotary mill using a pulverizing medium to produce metal oxide nano powder having a nano size.

Herein, the pulverizing medium may use beads having a diameter of 0.3 mm to 3.0 mm, and in the nano powder producing process, the metal oxides may be pulverized at 1,000 rpm to 4,000 rpm for 5 hours to 20 hours using methanol or ethanol as a solvent to produce metal oxide nano powder.

The beads may be formed of at least any one material selected from SUS, Zr, carbon steel, and steel.

Further, the alloy producing process may include a nano powder aggregate producing process of applying hot air to the metal oxide nano powder to produce a nano powder aggregate and a heat-treating process of putting the nano powder aggregate in a molten metal furnace and performing heat treatment to produce an alloy.

In this case, in the nano powder aggregate producing process, the nano powder may be aggregated by using any one of a chamber spray dryer, a hot air dryer, and a disk wheel dry plate.

Further, in the nano powder aggregate producing process, the metal oxide nano powder is added at a specific rate for each kind, and process conditions may include a slurry feeding rate of 0.5 l/min to 3.5 l/min. an internal tank temperature of 30° C. to 35° C., and a spraying pressure of 0.2 kPa to 2.5 kPa.

Meanwhile, the alloy producing process may include a natural metal producing process of producing the metal oxide nano powder into natural metal nano powder by a reduction process in a hydrogen or nitrogen atmosphere and a heat-treating process of putting the natural metal nano powder in a molten metal furnace and performing heat treatment to produce an alloy.

Herein, in the natural metal producing process, process conditions may include a hydrogen or nitrogen flow rate of 2.5 l/min to 7.0 l/min, a temperature of 1,100° C. to 1,500° C., a process time of 0.5 hr to 5.0 hr.

Further, the copper alloy production method may further include a nano powder anti-oxidizing coating process of forming an anti-oxidizing film on the natural metal nano powder with an additive after the natural metal producing process.

Herein, the additive may include any one selected from triethanolamine (TEA), oleic acid, amine, and acid-based polymer and may be added in the amount of 0.05 wt % to 3.0 wt % (powder rate).

Meanwhile, to achieve the above-described purpose, the present invention provides a method for manufacturing foil from a copper alloy, including a metal oxide preparing process of preparing at least two metals, including copper, each of which is in the form of a metal oxide, a nano powder producing process of pulverizing the metal oxides to produce metal oxide nano powder having a nano size, an alloy producing process of heat-treating the metal oxide nano powder to produce an alloy, a melting casting process of melting and casting the alloy, a treatment process of performing extrusion, hot rolling, and cold rolling after the casting process, and a heat-treating process of performing softening for imparting processability to a material through re-crystallization and annealing for removing residual stress caused by non-uniform plastic working.

Modes of the Invention

Hereinafter, exemplary embodiments of the present invention will be described in detail with reference to the accompanying drawings. However, the present invention is not limited to the exemplary embodiments disclosed below, but can be implemented in various forms. The following exemplary embodiments are provided only to complete disclosure of the present invention and to fully provide those of ordinary skill in the art with the category of the invention.

Figure 2:
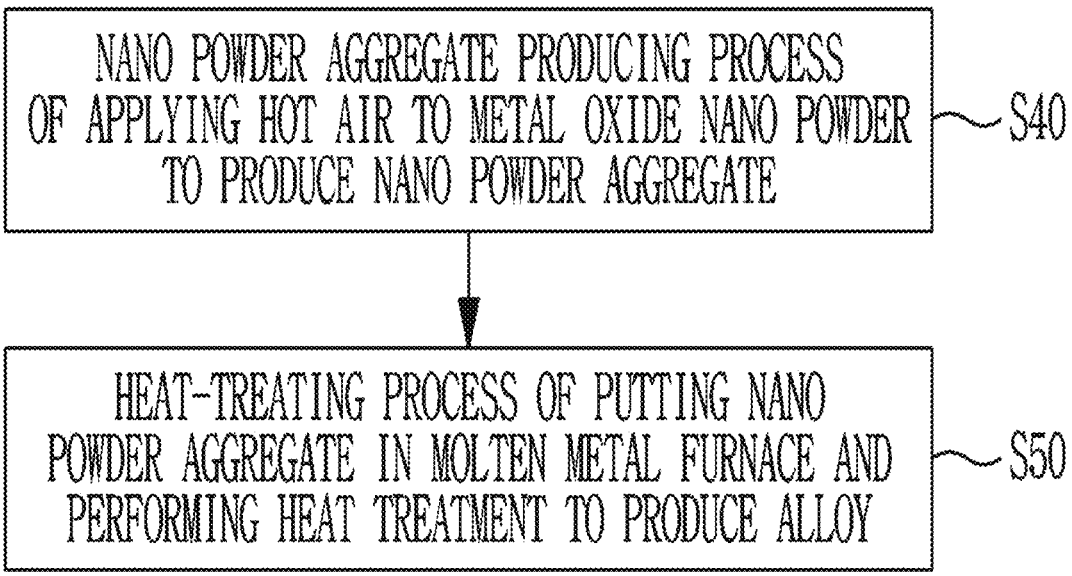
FIG. 2 is a flowchart showing a first exemplary embodiment of an alloy producing process according to the present invention.
Figure 3:
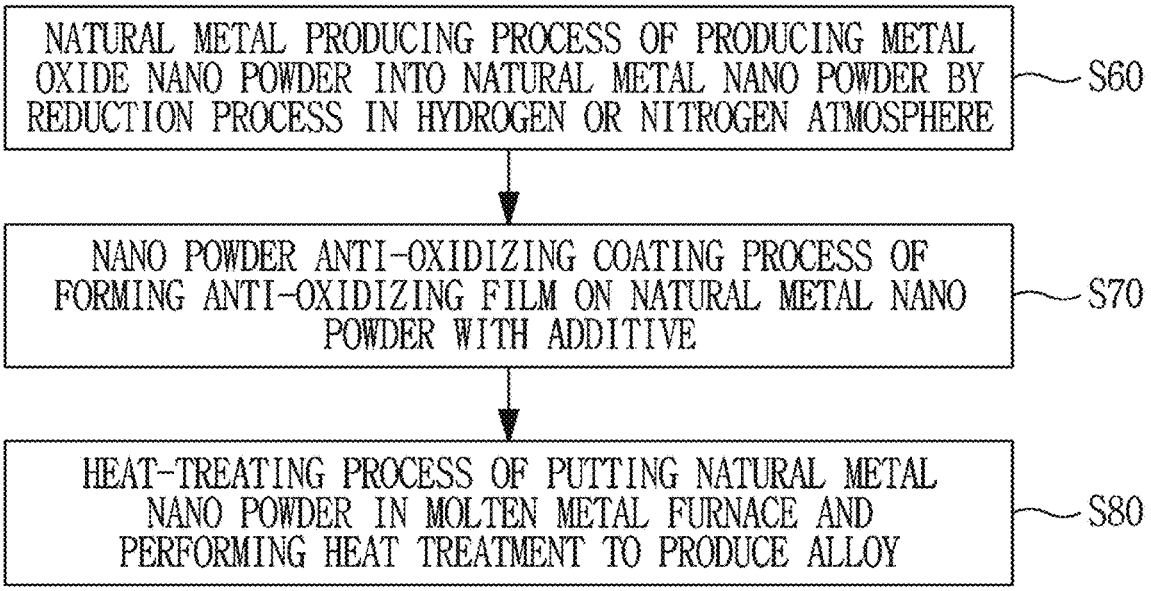
FIG. 3 is a flowchart showing a second exemplary embodiment of an alloy producing process according to the present invention.

FIG. 1 is a flowchart showing a copper alloy production method according to the present invention, FIG. 2 is a flowchart showing a first exemplary embodiment of an alloy producing process according to the present invention, and FIG. 3 is a flowchart showing a second exemplary embodiment of an alloy producing process according to the present invention.

Referring to FIG. 1, the copper alloy production method according to the present invention includes a metal oxide preparing process (S10) of preparing each of metals in the form of a metal oxide, a nano powder producing process (S20) of pulverizing the metal oxides to produce metal oxide nano powder having a nano size, and an alloy producing process (S30) of heat-treating the metal oxide nano powder to produce an alloy.

In the present invention, a copper alloy is produced using at least two metals including copper, and the copper alloy suggested in an exemplary embodiment of the present invention is improved in properties such as tensile strength by adding nickel (Ni) and zinc (Zn) to copper (Cu), and details thereof will be described below.

The copper alloy of the present invention is increased in strength, oxidation resistance and corrosion resistance by adding nickel (Ni) and zinc (Zn) to copper (Cu). Typically, copper alloys have high corrosion resistance and erosion resistance and relatively high strength and thus are widely used for pipes and plates of condensers, heat-exchangers, and chemical reaction apparatuses.

Cu as a basic element imparts toughness and facilitates cold work. Ni increases creep strength at high temperature and improves corrosion resistance. Further, Ni increases elastic modulus and electric resistance. As the content of Ni increases, a melting temperature range is shifted to high temperatures. Zn contributes to work hardening ability of the alloy and improves hot workability, but lowers corrosion resistance. As the content of Zn increases, the melting temperature range is shifted to low temperatures.

A copper alloy produced by alloying Cu, Ni, and Zn has properties such as a tensile strength of 750%, an elongation of 2.5%, an elastic strain of 1.3%, a resistance of 5 mil, a yield strength of 740 mpa, and a hardness of 175 $HV_{0.2}$ and is 2.5 or more times higher in tensile strength and yield strength than Cu. Thus, foil manufactured the copper alloy is less torn and can be more easily applied to a curved part than conventional copper foil.

In the present invention, metals to be contained in the copper alloy are not limited thereto, and may include other metals, such as cobalt, in addition to Cu, Ni. and Zn. Further, the contents of the respective metals may vary, but may not be limited in the present invention.

In the present invention, a technology of producing an alloy in the form of nanoscale powder is suggested to produce the copper alloy described above. To this end, each of the metals is prepared in the form of a metal oxide.

That is, Cu, Ni, and Zn are not pulverized in the form of metals, but metal oxides such as CuO, NiO, and ZnO are pulverized to primarily produce metal oxide nano powder having a nano size.

According to the conventional technology, metals such as Cu are pulverized with plasma into a powder form, which requires high cost. Also, the pulverized powder can be bound to each other by metallic bond. Thus, it is impossible to produce nanoscale powder.

To solve this problem, according to the present invention, metals are not pulverized, but prepared in the form of metal oxides, and the prepared metal oxides are pulverized. Since the pulverized metal oxides are not bound to each other, they can be pulverized into nanoscale powder.

That is, the metal oxides such as CuO, NiO, and ZnO are oxides. Thus, they do not clump together. Also, even if pulverized with a physical pulverizer without using plasma, they can be pulverized into nanoscale powder.

In the present invention, the metal oxides may be physically pulverized with a rotary mill using a pulverizing medium to produce metal oxide nano powder having a nano size.

As the rotary mill, a bead mill may be used, and ball mills such as a circulating bead mill, a circulating SC mill, a tilting ATT mill, a basket mill, etc. may be used.

Herein, preferably, the pulverizing medium may use beads having a diameter of 0.3 mm to 3.0 mm. Further, in the nano powder producing process, the metal oxides may be pulverized at 1,000 rpm to 4,000 rpm for 5 hours to 20 hours using methanol or ethanol as a solvent to produce metal oxide nano powder.

The suggested sizes of the pulverizing medium are in the most preferable range as a result of the experiments conducted several times by the present applicant. If the pulverizing medium has a diameter of less than 0.3 mm, it is difficult to physically pulverize the metal oxides, and if the pulverizing medium has a diameter of more than 3.0 mm, it is difficult to pulverize the metal oxides into a nano size and thus difficult to produce nano powder.

Then, if the pulverized metal oxide nano powder is produced into an alloy by performing heat treatment, a copper alloy can be produced using nano powder.

In the present invention, two exemplary embodiments of a process of producing a copper alloy using the metal oxide nano powder will be suggested.

As shown in FIG. 2, a first exemplary embodiment of the present invention may include a nano powder aggregate producing process (S40) of applying hot air to the metal oxide nano powder to produce a nano powder aggregate and a heat-treating process (S50) of putting the nano powder aggregate in a molten metal furnace and performing heat treatment to produce an alloy.

When the metal oxide nano powder, e.g., CuO, NiO, ZnO, etc., is dried while applying hot air thereto, metals in the metal oxides aggregate with each other, and, thus, a metal alloy can be produced.

In the nano powder aggregate producing process, the facilities such as a chamber spray dryer, a hot air dryer, or a disk wheel dry plate may be used to apply hot air, and in this case, process conditions may include a slurry feeding rate of 0.5 l/min to 3.5 l/min, an internal tank temperature of 30° C. to 35° C., and a spraying pressure of 0.2 kPa to 2.5 kPa.

According to the result of the experiments conducted several times by the present applicant, the aggregation of nano powder occurs best under process conditions such as a slurry feeding rate of 1.5 l/min, an internal tank temperature of 32° C., and a spraying pressure of 0.8 kPa. Thus, the optimal process conditions for producing the nano powder aggregate may include a slurry feeding rate of 1.5 l/min, an internal tank temperature of 32° C., and a spraying pressure of 0.8 kPa.

Meanwhile, to produce the nano powder aggregate, the metal oxide nano powder may be preferably added at a specific rate for each kind. That is, when metal oxides of Cu, Ni, and Zn are put in a hot air dryer and dried therein with hot air, CuO, NiO, and ZnO may be preferably added at a ratio of an alloy to be produced.

For example, if an alloy containing 79% Cu, 20% Ni, and 1% Zn is produced, CuO, NiO, and ZnO may be added at the same ratio and then applied with hot air. Then, metals of the respective metal oxides may be aggregated into a Cu—Ni—Zn alloy. In this case, the composition ratio of the Cu—Ni—Zn alloy may be 79% Cu, 20% Ni, and 1% Zn.

As such, if the nano powder aggregate which has been aggregated at a ratio of an alloy is put in the molten metal furnace and heated therein, the alloy can be produced at lower temperatures. Thus, it becomes easier to produce a copper alloy.

As shown in FIG. 3, a second exemplary embodiment of the alloy producing process of the present invention may include a natural metal producing process (S60) of producing the metal oxide nano powder into natural metal nano powder by a reduction process in a hydrogen or nitrogen atmosphere and a heat-treating process (S80) of putting the natural metal nano powder in a molten metal furnace and performing heat treatment to produce an alloy.

That is, in the second exemplary embodiment of the alloy producing process of the present invention, hydrogen is added to the metal oxide nano powder to obtain natural meal by a hydrogen reduction process.

An example of hydrogen reduction is performed as shown in the following formula.

$$CuO+H_2 \rightarrow Cu+H_2O$$

When hydrogen is added to the metal oxide nano powder by the hydrogen reduction process as shown above, natural metal nano powder can be produced.

Figure 5:
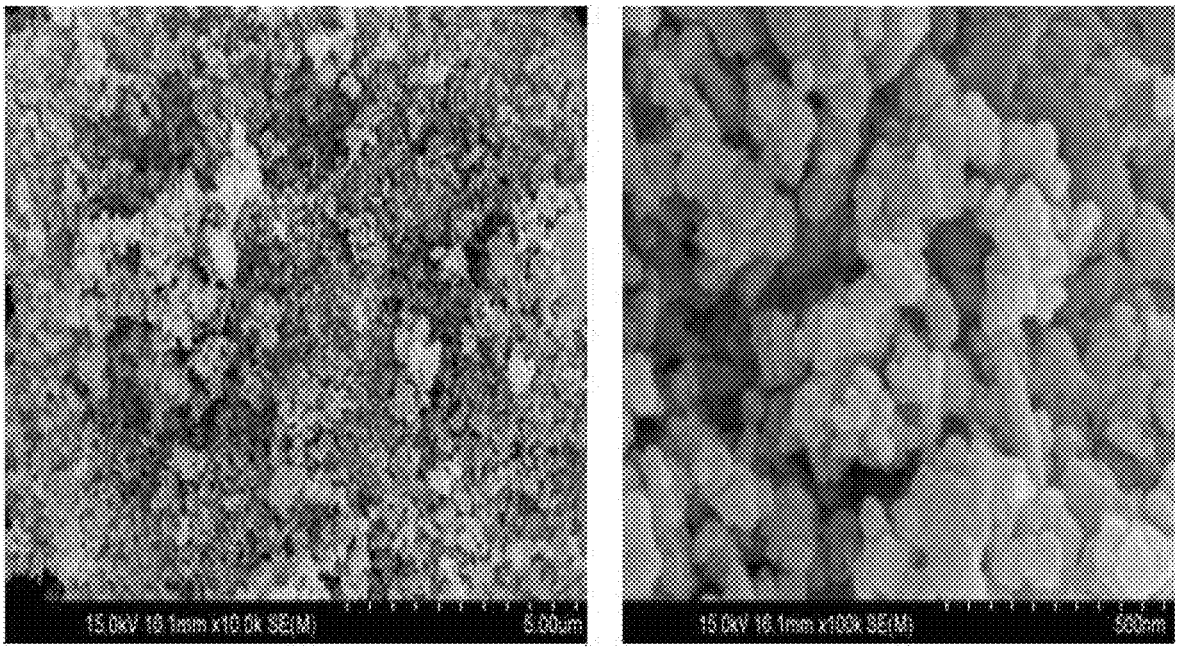
FIG. 5 shows scanning electron microscope (SEM) images of nanoscale particles produced according to the present invention.

FIG. 5 shows scanning electron microscope (SEM) images of nanoscale particles produced according to the present invention. If an alloy is produced using nano powder including nanoscale particles as shown in FIG. 5, temperatures of liquefaction can be lowered. Therefore, in the present invention, the energy band gap for alloying can be lowered and metals can be actually alloyed within 80% of the temperature range, and, thus, energy can be saved.

Meanwhile, in the hydrogen reduction process, heat needs to be applied while hydrogen is added.

In the natural metal producing process, preferable process conditions may include a hydrogen or nitrogen flow rate of 2.5 l/min to 7.0 l/min, a temperature of 1.100° C. to 1.500° C., a process time of 0.5 hr to 5.0 hr.

Further, the copper alloy production method may further include a nano powder anti-oxidizing coating process (S70) of forming an anti-oxidizing film on the natural metal nano powder with an additive after the natural metal producing process.

That is, natural metals in nano powder form can be easily oxidized, and to suppress the easy oxidation, the process of coating an anti-oxidizing film on the nano powder may be performed. In this case, the additive may include any one selected from triethanolamine (TEA), oleic acid, amine, and acid-based polymer and may be preferably added in the amount of 0.05 wt % to 3.0 wt % (powder rate).

Then, the natural metal nano powder is put in the molten metal furnace and heated therein, a copper alloy can be produced using the nano powder. As such, according to the present invention, a copper ally is prepared using nanoscale metal powder. Therefore, it is possible to greatly lower temperatures of heating the metal materials and thus possible to suppress waste of energy. Also, it is possible to produce a copper alloy at low cost.

Further, an alloy is produced from nano powder form in a molten metal furnace. Therefore, it is possible to minimize the generation of oxides on the outer wall of the molten metal furnace and thus possible to reduce waste of materials and eliminate unnecessary removal of the oxides. Also, it is possible to optimize the characteristics of the alloy.

Figure 4:
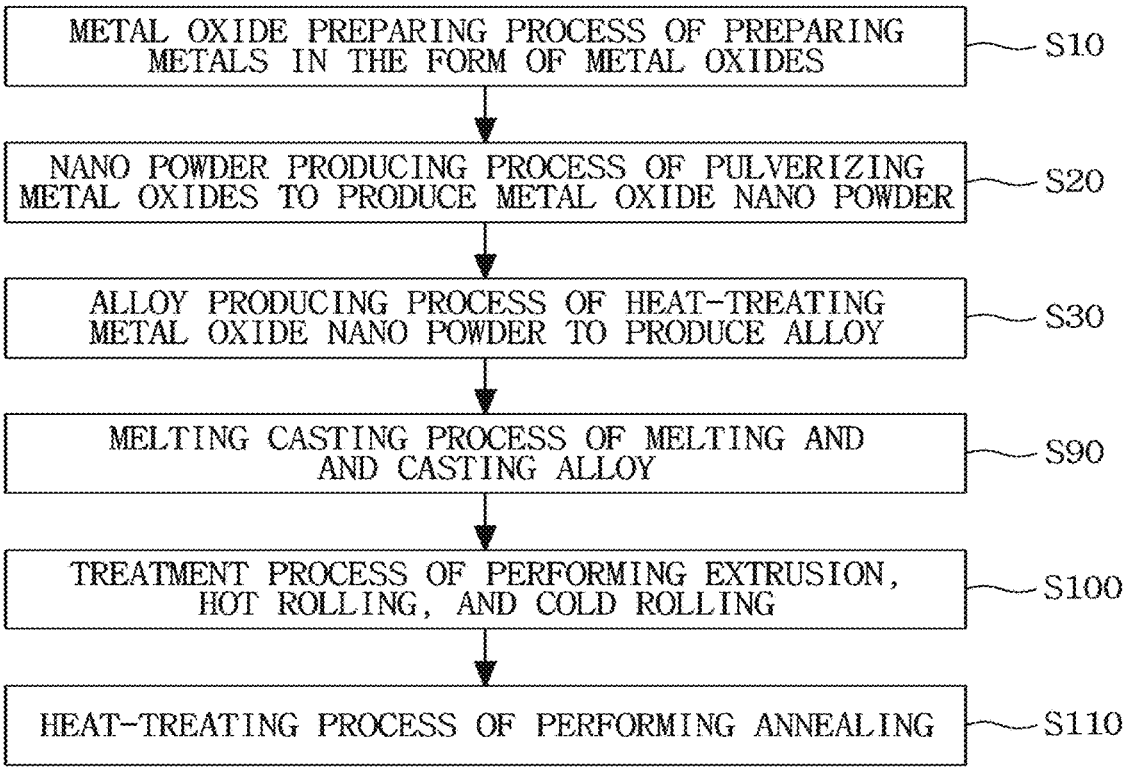
FIG. 4 is a flowchart showing a method for manufacturing foil from a copper alloy according to the present invention.

FIG. 4 is a flowchart showing in a method for manufacturing foil from a copper alloy according to the present invention.

In the present invention, a copper alloy foil can be manufactured from the copper alloy produced using the nano powder as described above.

A method for manufacturing copper alloy foil according to the present invention may include a metal oxide preparing process (S10) of preparing at least two metals, including copper, each of which is in the form of a metal oxide, a nano powder producing process (S20) of pulverizing the metal oxides to produce metal oxide nano powder having a nano size, an alloy producing process (S30) of heat-treating the metal oxide nano powder to produce an alloy, a melting casting process (S90) of melting and casting the alloy, a treatment process (S100) of performing extrusion, hot rolling, and cold rolling after the casting process, and a heat-treating process (S110) of performing softening for imparting processability to a material through re-crystallization and annealing for removing residual stress caused by non-uniform plastic working.

The metal oxide preparing process (S10) to the alloy producing process (S30) are performed as described above. Therefore, a detailed explanation thereof will be omitted.

To manufacture copper alloy foil, the copper alloy prepared in the alloy producing process may be used for casting.

In this case, Mn is suitable for deoxidation and desulphurization and added in the form of the $CuMn_{30}$ master alloy. In general, a sufficient amount of Mn is added until the minimum residual amount of Mn in the molten metal furnace reaches about 0.2%. To suppress Zn vaporization, it is necessary to avoid the overheating of the molten metal furnace. The temperature for casting ranges from about 1,100° C. to about 1,300° C., and the solidification shrinkage rate is from about 1.6% to about 1.8%, which should be taken into account when producing a casting mold.

The alloy can be easily casted by using the general casting method of centrifugal sand casting, continuous casting, molding casting, etc.

Then, the treatment process (S100) of performing extrusion, hot rolling, and cold rolling is performed.

An ingot is produced into a board, a pipe, a rod, a thin wire, etc. by the hot work like extrusion or hot rolling. The hot work temperature is set between 600° C. to 900° C. depending on the composition of an alloy. The hot work requires a high purity of an alloy, and the temperature needs to be accurately controlled because the possible hot work temperature range is around 50° C.

Like all the other metal materials, the strength of a Cu alloy is improved through the work hardening by cold work, and different strength (properties) is controlled depending on the cold workability. For example, the tensile strength of $CuNi_{12}Zn_{24}$ foil ranges from about 340 $N/mm^2$ to about 610 $N/mm^2$, and the increase in strength is linked to the reduction of the cold workability.

After the treatment process of performing hot rolling and cold rolling, softening for imparting processability to a material through re-crystallization and annealing for removing residual stress caused by non-uniform plastic working are performed.

The intermediate annealing for re-crystallization or annealing of final product is performed at a temperature between about 580° C. to about 650° C. depending on the composition of an alloy and cold workability. The temperature for annealing leaded nickel silver range from about 580° C. to about 600° C., slightly lower than the range of from 620° C. to 650° C. as the annealing temperature of unleaded nickel silver. Particularly, for leaded nickel silver, the temperature has to be increased slowly to suppress stress cracking at the time of annealing. The annealing temperature for softening increases in proportion to the content of Ni. Cold work needs to be performed at least 20% before annealing to suppress growing of a coarse particle structure that is generated by low cold workability (5% to 10%) during annealing. The intermediate annealing may be performed in a reduction atmosphere to suppress the formation of an oxide film on the surface. A Cu alloy has annealing brittleness and needs to be heated or cooled slowly at a temperature ranging from 250° C. to 400° C. to suppress stress cracking.

Figure 6:
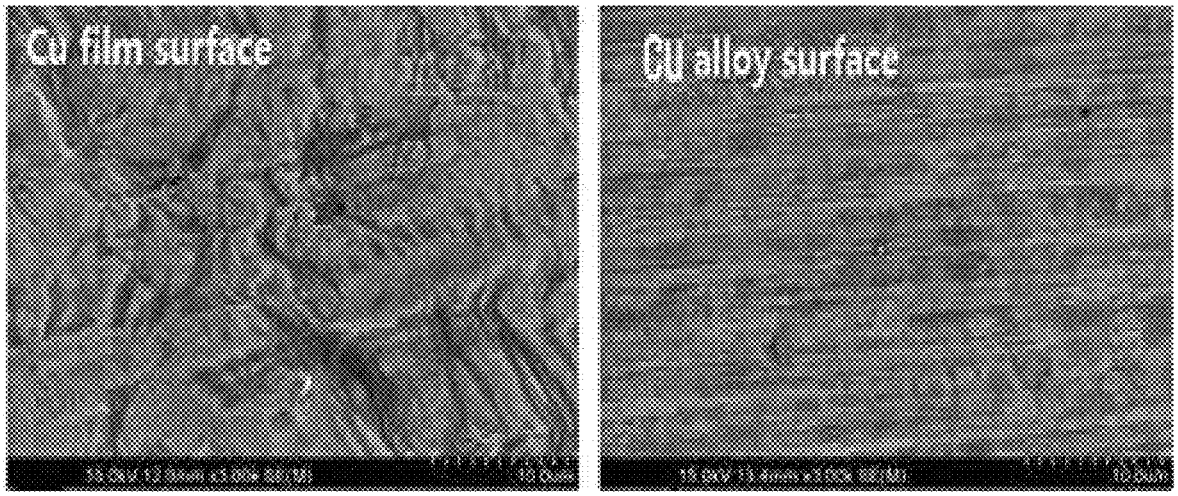
FIG. 6 shows scanning electron microscope (SEM) images of the surface of conventional copper foil and the surface of copper alloy foil produced according to the present invention, respectively.
Figure 7:
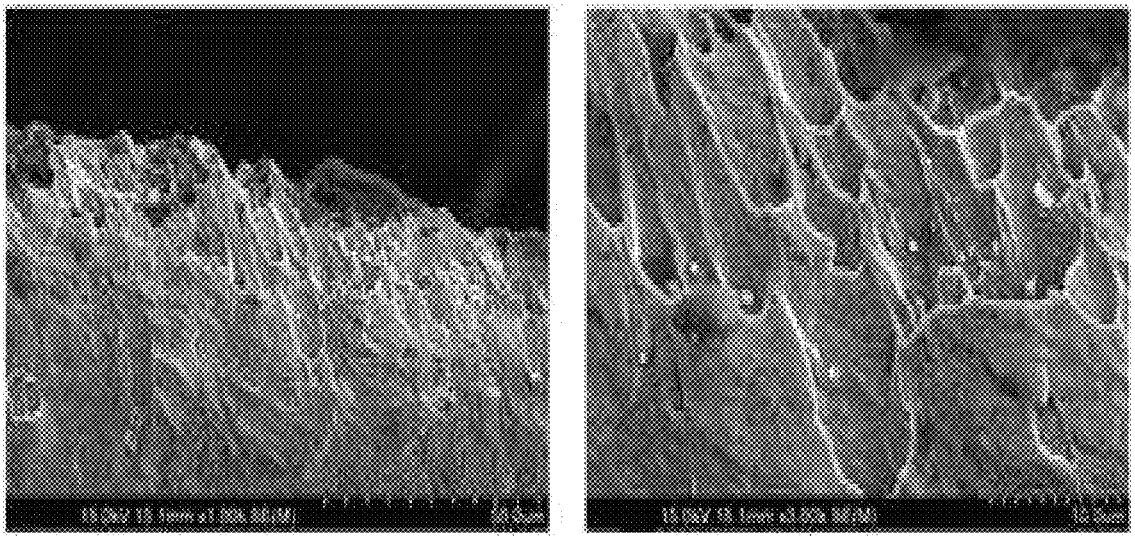
FIG. 7 PRIOR ART
FIG. 7 and FIG. 8 are photos comparing the generation of precipitates.
Figure 8:
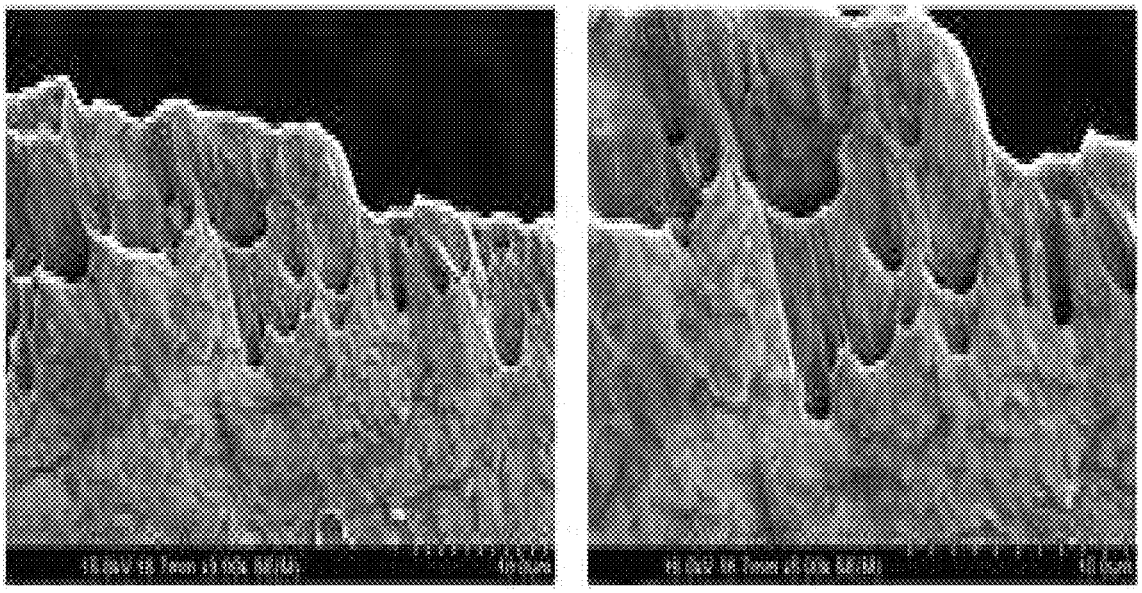

FIG. 6 shows scanning electron microscope (SEM) images of the surface of conventional copper foil and the surface of copper alloy foil produced according to the present invention, respectively, and FIG. 7 and FIG. 8 are photos comparing the generation of precipitates. FIG. 7 shows scanning electron microscope (SEM) images of the fracture surface of copper foil produced according to a conventional production method, and FIG. 8 shows scanning electron microscope (SEM) images of the fracture surface of copper alloy foil produced according to a copper alloy foil production method of the present invention.

As shown in FIG. 6 to FIG. 8, it can be seen that the surface of the copper alloy is smoother than the surface of the copper foil and very few precipitates are generated on the copper alloy.

Further, the copper alloy foil is very excellent in strength compared to copper foil because it is 2.5 or more times higher in tensile strength and yield strength than Cu.

The copper alloy produced as described above can be applied to various fields such as electric resistance heating elements, conductive materials, absorption materials, rivet screws, optical instruments, etching materials, plated rods, silver-plated substrates, artificial accessories, etching materials, radio dials, parts for cameras, optical instruments, etching stokes, artificial accessories, springs, resistance wires, parts for watches, etc.

The scope of the present invention is not limited to the exemplary embodiments described above but should be defined by the following claims. However, it is obvious to those of ordinary skill in the art that various changes and modifications can be made without departing from the scope of the present invention.

The invention claimed is:

1. A copper alloy production method, comprising:

a metal oxide preparing process of preparing at least two metals, at least one metal comprising copper, each of which is in the form of a metal oxide;

a nano powder producing process of pulverizing the metal oxide to produce a metal oxide nano powder having a nano size; and an alloy producing process of heat-treating the metal oxide nano powder to produce an alloy, wherein the alloy producing process comprises:

a nano powder aggregate producing process of applying hot air using a dryer to the metal oxide nano powder to produce a nano powder aggregate; and a heat-treating process of putting the nano powder aggregate in a furnace and performing a heat treatment to produce an alloy, wherein in the nano powder aggregate producing process, a slurry comprising the metal oxide nano powder is supplied to the dryer at a feeding rate of 0.5 l/min to 3.5 l/min, a dryer temperature is 30° C. to 35° C., and a pressure of the applied hot air is 0.2 kPa to 2.5 kPa.

2. The copper alloy production method of claim 1, wherein the metal oxide comprises at least two of CuO, NiO, and ZnO.

3. The copper alloy production method of claim 1, wherein in the nano powder producing process, the metal oxide is physically pulverized with a rotary mill using a pulverizing medium to produce the metal oxide nano powder having the nano size.

4. The copper alloy production method of claim 3, wherein the pulverizing medium uses beads having a diameter of 0.3 mm to 3.0 mm, and in the nano powder producing process, the metal oxide is pulverized at 1,000 rpm to 4,000 rpm for 5 hours to 20 hours using methanol or ethanol as a solvent to produce the metal oxide nano powder.

5. The copper alloy production method of claim 4, wherein the beads are formed of at least any one material selected from the group consisting of stainless steel, Zr, and carbon steel.

6. The copper alloy production method of claim 1, wherein in the nano powder aggregate producing process, the nano powder is aggregated by using any one of a chamber spray dryer, a hot air dryer, and a disk wheel dry plate.

7. The copper alloy production method of claim 1, wherein in the metal producing process, process conditions include a hydrogen or nitrogen flow rate of 2.5 l/min to 7.0 l/min, a temperature of 1,100° C. to 1,500° C., a process time of 0.5 hr to 5.0 hrs.

8. The copper alloy production method of claim 1, further comprising:

a nano powder anti-oxidizing coating process of forming an anti-oxidizing film on the metal nano powder with an additive after the metal producing process.

9. The copper alloy production method of claim 8, wherein the additive comprises any one selected from the group consisting of triethanolamine (TEA), oleic acid, amine, and acid-based polymer and is added in the amount of 0.05 wt % to 3.0 wt % powder rate.

* * * * *